US009848681B1

(12) United States Patent
Chen

(10) Patent No.: US 9,848,681 B1
(45) Date of Patent: Dec. 26, 2017

(54) TRAVEL LUGGAGE WITH PUSH AND PULL FUNCTIONS

(71) Applicant: Wei-Chih Chen, Taipei (TW)

(72) Inventor: Wei-Chih Chen, Taipei (TW)

( * ) Notice: Subject to any disclaimer, the term of this patent is extended or adjusted under 35 U.S.C. 154(b) by 0 days.

(21) Appl. No.: 15/421,396

(22) Filed: Jan. 31, 2017

(51) Int. Cl.
*A45C 5/14* (2006.01)
*A45C 13/26* (2006.01)
*A45C 5/03* (2006.01)

(52) U.S. Cl.
CPC ..... *A45C 13/262* (2013.01); *A45C 5/03* (2013.01); *A45C 5/14* (2013.01); *A45C 2013/265* (2013.01); *A45C 2013/267* (2013.01)

(58) Field of Classification Search
CPC . A45C 13/262; A45C 2013/265; A45C 5/146; A45C 5/14; A45C 2013/167
USPC ..... 190/18 A; 16/34
See application file for complete search history.

(56) References Cited

U.S. PATENT DOCUMENTS 4,217,675 A * 8/1980 Haft ..... A45C 5/146 16/19
4,273,222 A * 6/1981 Cassimally ..... A45C 5/146 190/18 A
4,340,132 A * 7/1982 Cerna ..... A45C 13/385 190/18 A
5,114,164 A * 5/1992 Bothwell ..... A45C 5/146 190/18 A
5,385,220 A * 1/1995 Pond ..... A45C 5/14 190/115
5,484,046 A * 1/1996 Alper ..... A45C 5/146 190/115
5,778,488 A * 7/1998 Tsai ..... A45C 5/146 16/34
6,041,900 A * 3/2000 Sadow ..... A45C 5/14 190/115
6,193,033 B1 * 2/2001 Sadow ..... A45C 5/14 16/405
6,345,414 B1 * 2/2002 Chen ..... A45C 5/14 16/113.1
8,118,145 B1 * 2/2012 Hamamy ..... A45C 5/14 190/18 A
2003/0006110 A1 * 1/2003 Lin ..... A45C 5/14 190/18 A
2008/0000742 A1 * 1/2008 Lee ..... A45C 5/14 190/18 A
2010/0175960 A1 * 7/2010 Moskowitz ..... A45C 5/14 190/11
2014/0188201 A1 * 7/2014 Pianca ..... A61N 1/05 607/116

* cited by examiner

*Primary Examiner* — Sue A Weaver

(57) ABSTRACT

A travel luggage includes a luggage body including a bottom panel and a back panel connected at right angles and first handle grooves and second handle grooves respectively located on the bottom panel and the back panel and respectively connected in lines, and a direction-changeable retractable handle assembly including a retractable handle and two pivots pivotally connecting the retractable handle to the luggage body so that the retractable handle can be selectively set in a first operation mode position where the retractable handle is positioned in the first handle grooves, or a second operation mode position where the retractable handle is positioned in the second handle grooves.

3 Claims, 7 Drawing Sheets

TRAVEL LUGGAGE WITH PUSH AND PULL FUNCTIONS

BACKGROUND OF THE INVENTION

1. Field of the Invention

The present invention relates to luggage and more particularly to a travel luggage with push and pull functions, which has the retractable handle pivotally connected in the junction between the top and bottom panels of the luggage body and selectively set between two operation mode positions so that the luggage body can be supported and moved on the floor selectively in horizontal or vertical.

2. Description of the Related Art

In a long travel or business trip, people generally will carry a large quantity of clothing and daily necessities. Apart from receiving the clothing and daily necessities in the travel luggage, people will carry extra containers such as backpacks to accommodate other articles that cannot be accommodated in the travel luggage. Thus, while pulling the travel luggage, the user needs to carry the backpacks or other extra containers on the back or with the hands. In addition to giving a physical burden to the user, this manner can also increase the inconvenience to the user's action and cause the articles easy to fall or to be lost.

SUMMARY OF THE INVENTION

The present invention has been accomplished under the circumstances in view. It is therefore the main object of the present invention to provide a travel luggage with push and pull functions, which has the retractable handle pivotally connected in the juction between the top and bottom panels of the luggage body and selectively set between two operation mode positions so that the luggage body can be supported and moved on the floor selectively in horizontal or vertical.

To achieve this and other objects of the present invention, a travel luggage comprises a luggage body and direction-changeable retractable handle assembly. The luggage body comprises a bottom panel and a back panel connected at right angles, two adjustable luggage wheels bilaterally and pivotally mounted in the junction between the bottom panel and the back panel and selectively set between a vertical position suspending outside the bottom panel and a horizontal position suspending outside the back panel, two bottom luggage wheels bilaterally mounted at said bottom panel remote from said adjustable luggage wheels, two hidden luggage wheels bilaterally pivotally mounted in the back panel remote from the adjustable luggage wheels and selectively set between an extended position where the hidden luggage wheels are disposed outside the back panel and a received position where the hidden luggage wheels are received inside the back panel, at least one first handle groove located on the bottom panel, and at least one second handle groove located on the back panel and longitudinally connected to the at least one first handle groove. The direction-changeable retractable handle assembly comprises a retractable handle and at least one pivot mounted in the luggage body to pivotally connect the retractable handle to the luggage body for enabling the retractable handle to be selectively set in a first operation mode position where the retractable handle is positioned in the at least one first handle groove and a second operation mode position where the retractable handle is positioned in the at least one second handle groove.

Preferably, the luggage body further comprises two wheel chambers bilaterally located in the back panel remote from the adjustable luggage wheels. Further, the hidden luggage wheels are respectively pivotally mounted in the wheel chambers and biasable relative to the luggage body between the extended position and the received position.

Preferably, the luggage body further comprises two angled grooves bilaterally located in the junction between the bottom panel and the back panel, and two recessed holes located in each angled groove at two opposite sides. Further, each adjustable luggage wheel of the luggage body comprises a pivot block having two opposite ends thereof respectively pivotally mounted in the recessed holes in one respective angled groove, a wheel bracket affixed to the pivot block, and a wheel rotatably mounted in the wheel bracket.

DETAILED DESCRIPTION OF THE PREFERRED EMBODIMENT

Figure 1:
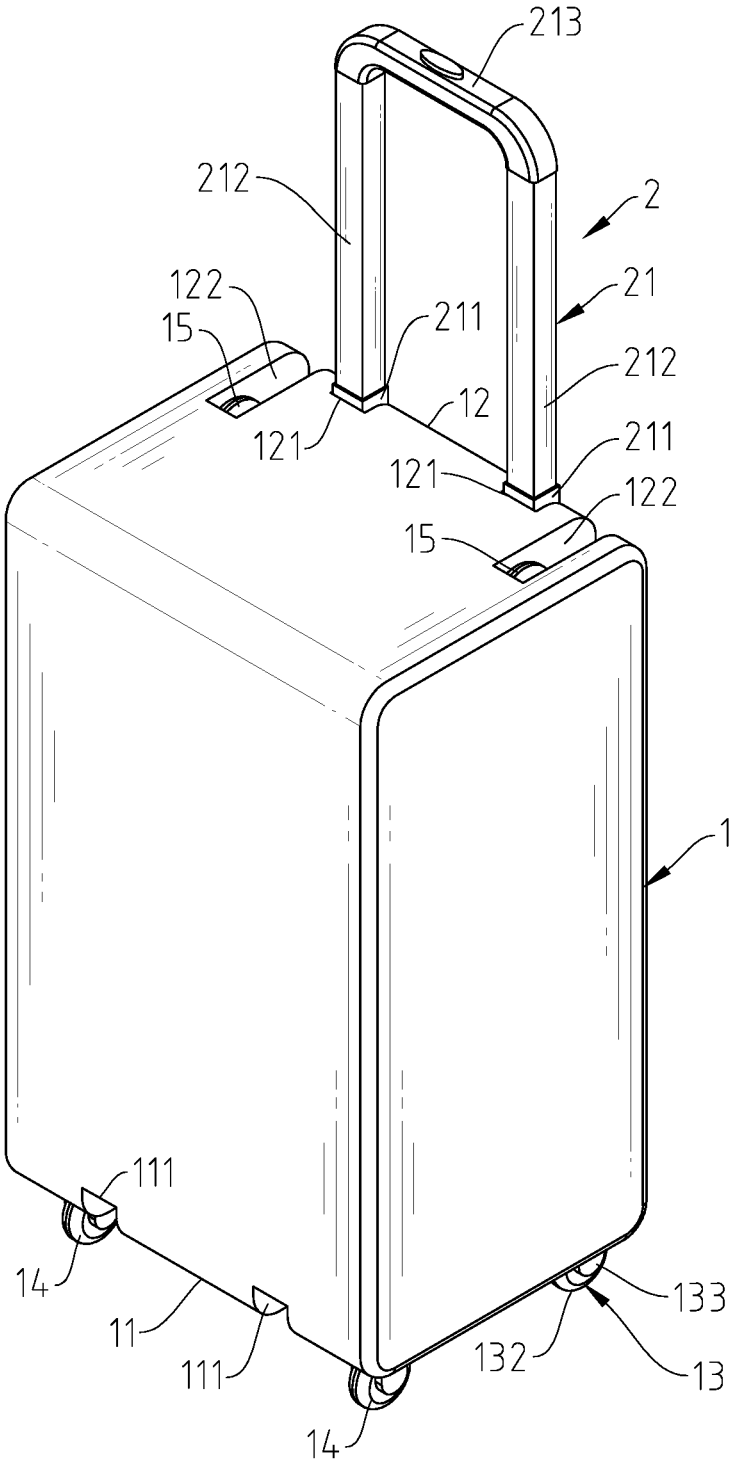
FIG. 1 is an oblique front elevational view of a travel luggage in a first operation mode position in accordance with the present invention.
Figure 2:
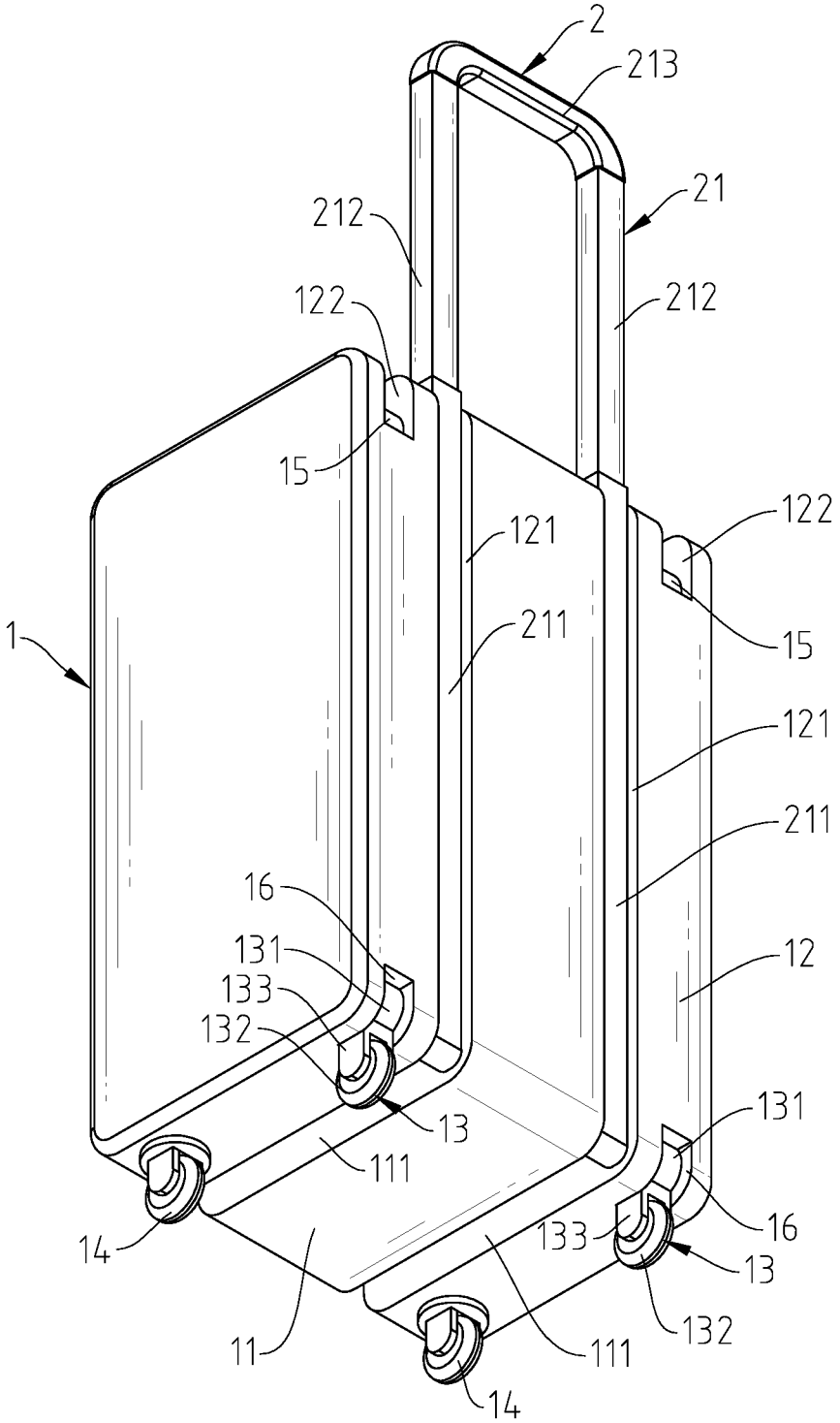
FIG. 2 is an oblique rear elevational view of the travel luggage in the first operation mode position in accordance with the present invention.
Figure 3:
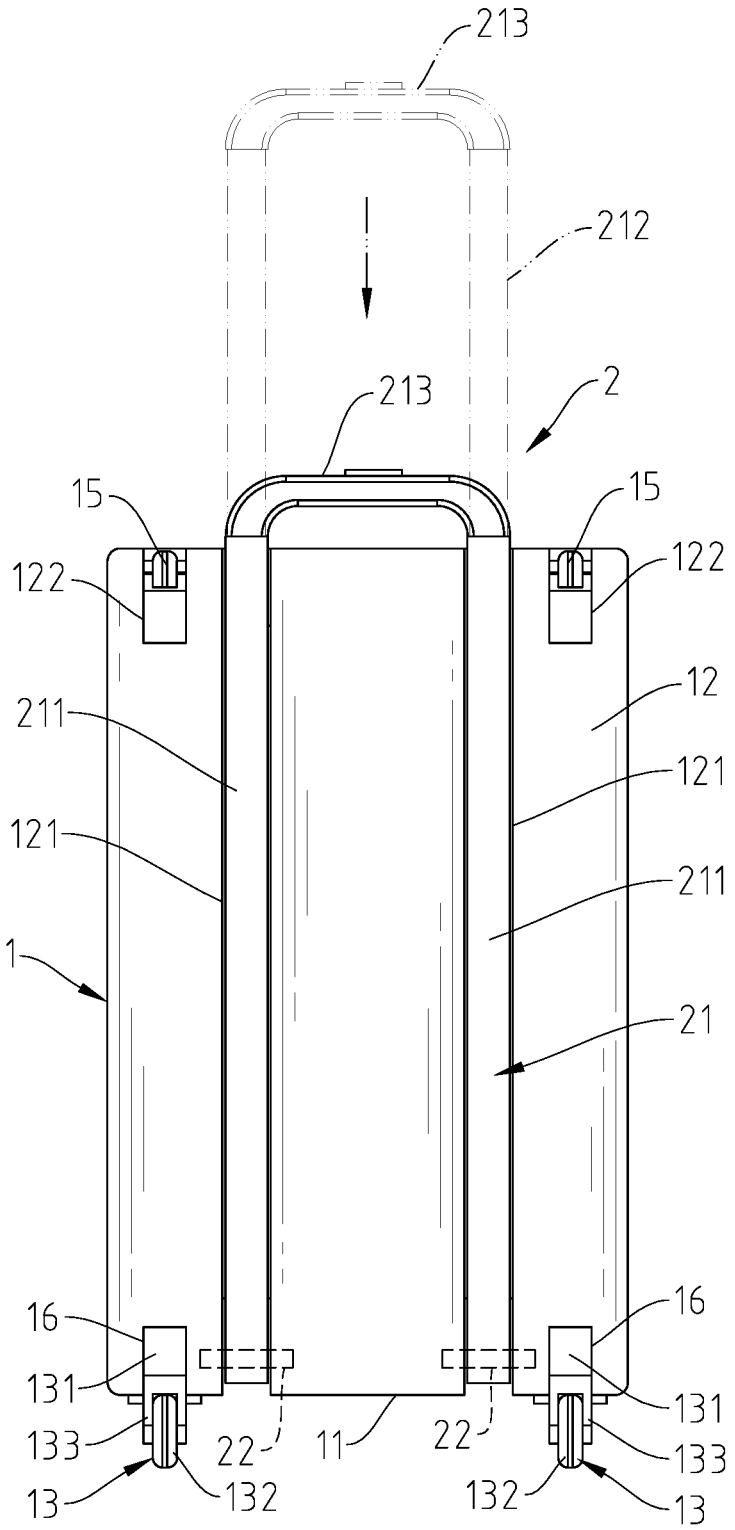
FIG. 3 is a schematic back side view of the present invention, illustrating the retractable handle positioned in the second handle grooves and the inner tubes moved with the grip in and out of the respective outer tubes.

Referring to FIGS. 1-3 and FIG. 7, a travel luggage with push and pull functions in accordance with the present invention is shown. The travel luggage comprises a luggage body 1 and a direction-changeable retractable handle assembly 2.

The luggage body 1 comprises a bottom panel 11 and a back panel 12 connected at right angles, two angled grooves 16 bilaterally located in the junction between the bottom panel 11 and the back panel 12, two adjustable luggage wheels 13 respectively and pivotally mounted in the angled grooves 16, two bottom luggage wheels 14 bilaterally and fixedly mounted at the bottom panel 11 remote from the adjustable luggage wheels 13, and two hidden luggage wheels 15 bilaterally mounted in the back panel 12 remote from the adjustable luggage wheels 13. Further, each adjustable luggage wheel 13 comprises a pivot block 131 pivotally mounted in the respective angled groove 16, a wheel bracket 133 affixed to the pivot block 131, and a wheel 132 rotatably mounted in the wheel bracket 133. The luggage body 1 comprises two recessed holes 161 located in each angled groove 16 at two opposite sides. The pivot block 131 of each adjustable luggage wheel 13 has two opposite ends thereof respectively pivotally mounted in the two recessed holes 161 in the respective angled groove 16.

The luggage body 1 further comprises two first handle grooves 111 located on the bottom panel 11 in a parallel manner, two second handle grooves 121 located on the back panel 12 in a parallel manner and respectively longitudinally connected to the first handle grooves 111, first and second retaining devices (not shown) respectively mounted in the first handle grooves 111 and the second handle groove 121, and two wheel chambers 122 bilaterally located on the back panel 12 remote from the angled groove 16. The hidden luggage wheels 15 are respectively pivotally mounted in the wheel chambers 122.

The direction-changeable retractable handle assembly 2 comprises a retractable handle 21 and two pivots 22. The retractable handle 21 comprises two outer tubes 211 arranged in parallel, two inner tubes 212 respectively mounted in the outer tubes 211, and a grip 213 transversely connected between respective one ends of the inner tubes 212 outside the outer tubes 211 and operable to move the inner tubes 212 in and out of the respective outer tubes 211 between an extended position and a received position to adjust the length of the retractable handle 21. The two pivots 22 are respectively pivotally inserted through respective one ends of the outer tubes 211 remote from the grip 213 and respectively mounted in the junction between the bottom panel 11 and back panel 12 of the luggage body 1 within the respective connection areas between the first handle grooves 111 and the second handle grooves 121 to pivotally connect the retractable handle 21 to the luggage body 1.

Figure 4:
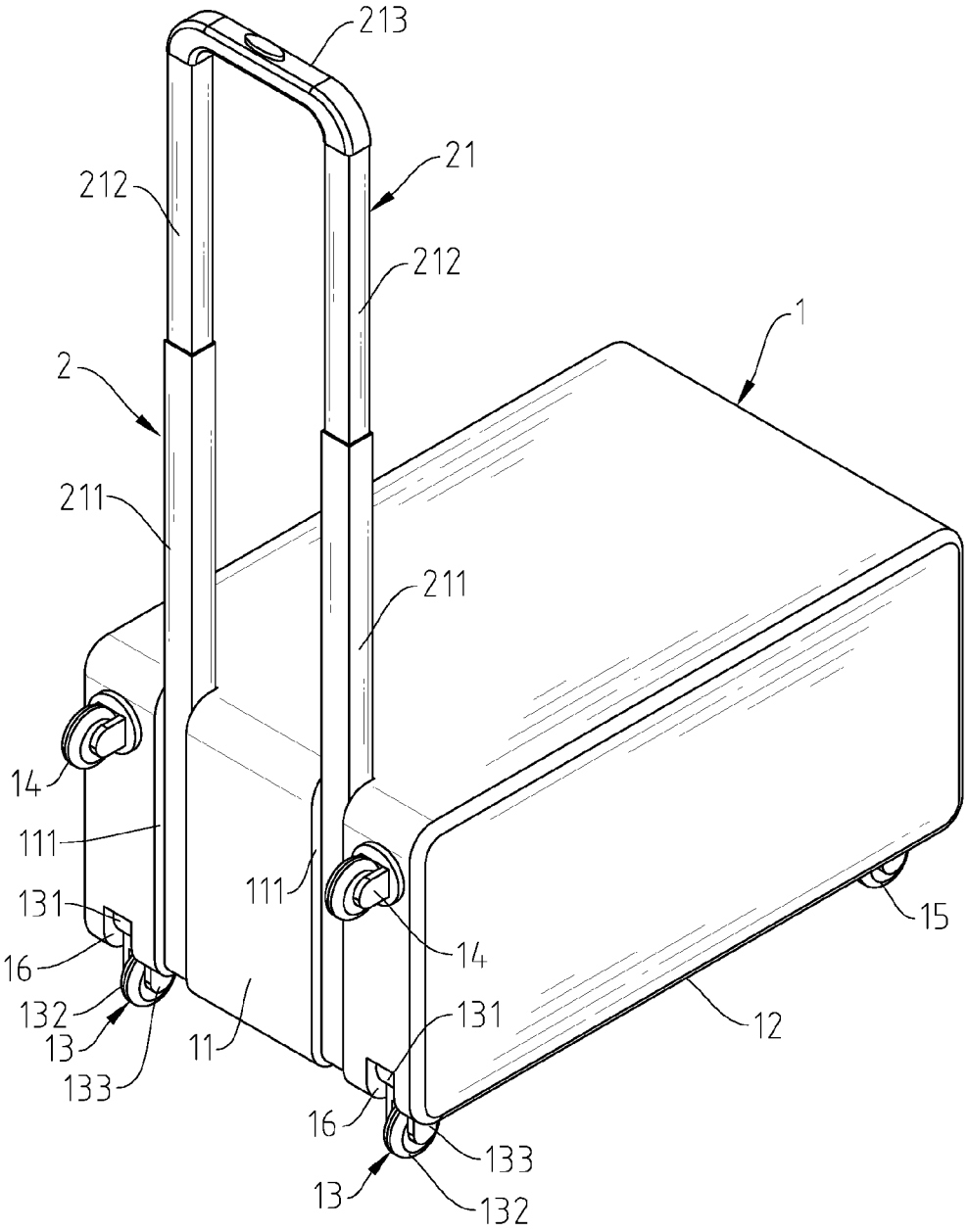
FIG. 4 is an oblique elevational view of the present invention, illustrating the retractable handle set in the second operation mode position.
Figure 5:
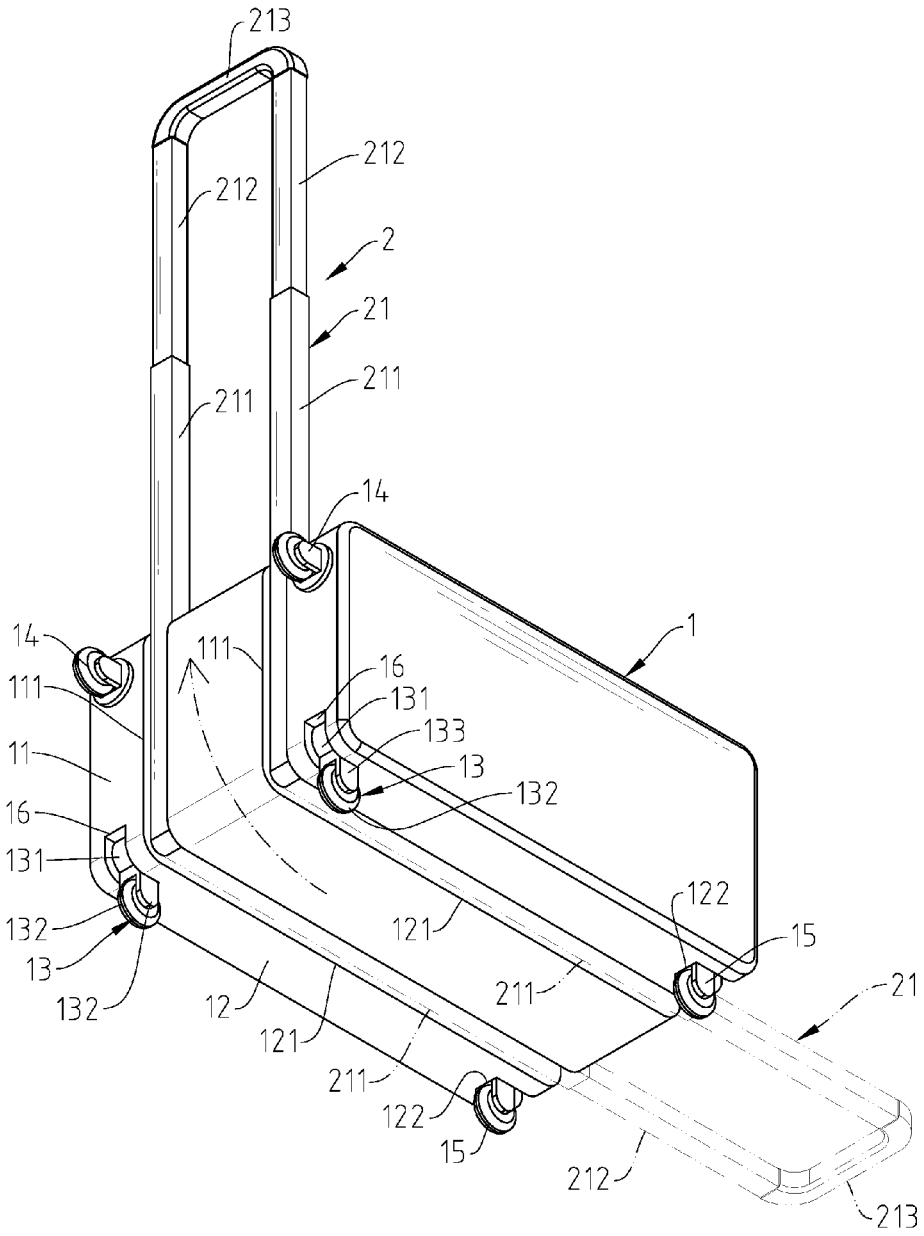
FIG. 5 is a schematic drawing of the present invention, illustrating the retractable handle moved relative to the luggage body between the first operation mode position and the second operation mode position.
Figure 6:
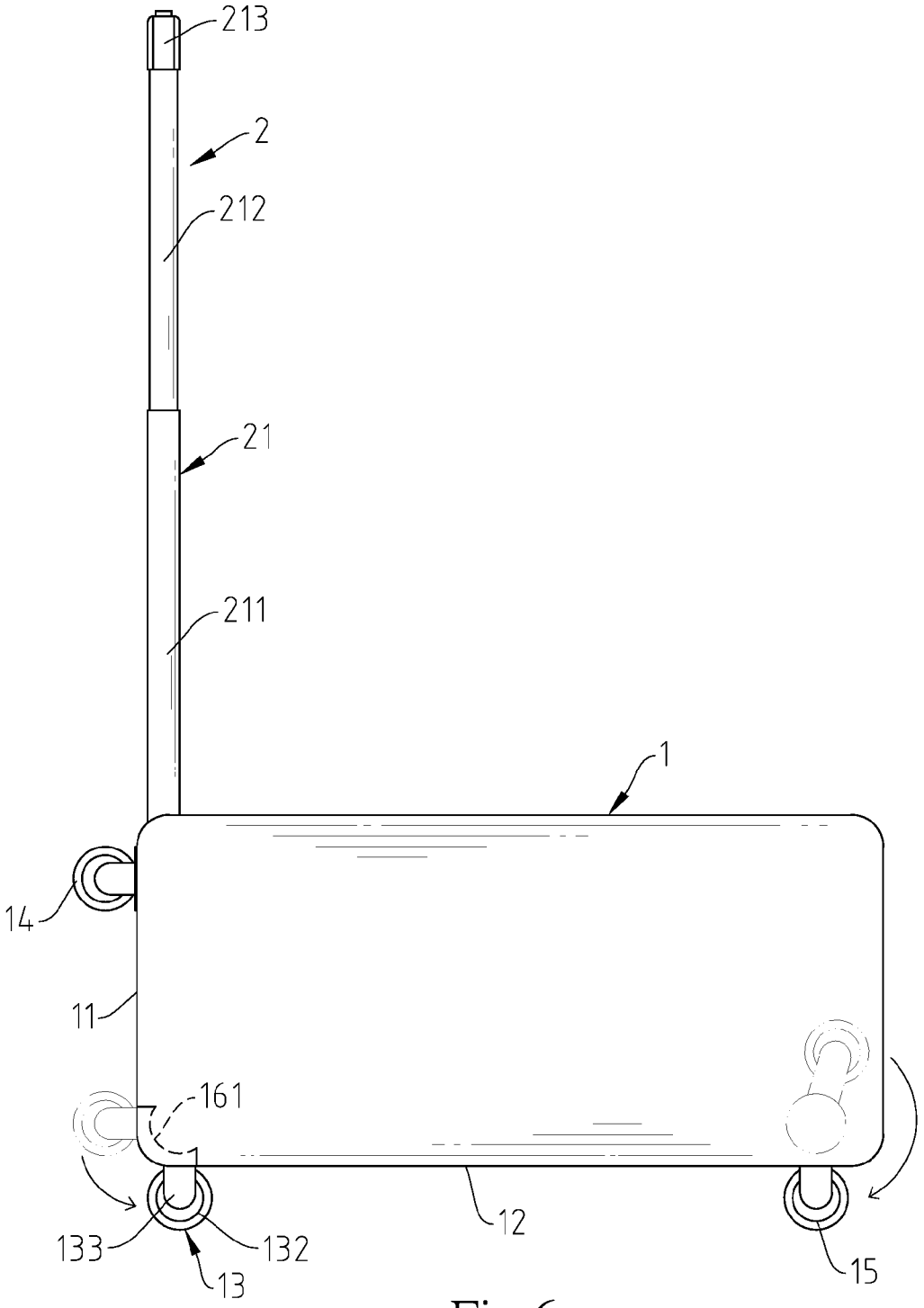
FIG. 6 is a schematic side view of the present invention, illustrating the adjustable luggage wheels and the hidden luggage wheels respectively set between two opposite positions relative to the luggage body.
Figure 7:
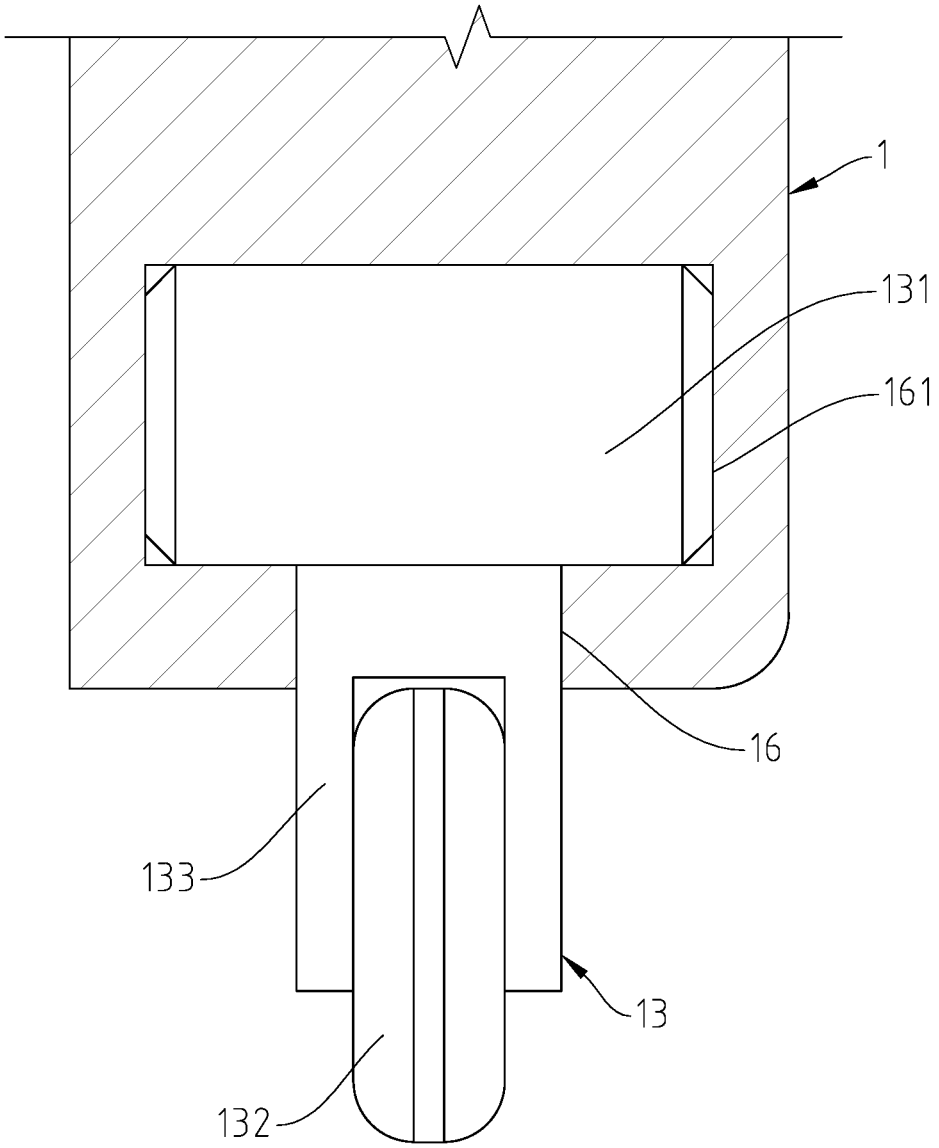
FIG. 7 is a schematic sectional view, in an enlarged scale, of a part of the present invention, illustrating the adjustable luggage wheel positioned in the respective angled groove.

The travel luggage can be selectively set between a first operation mode (see FIG. 1) and a second operation mode (see FIG. 4). When the travel luggage is set in the first operation mode, as illustrated in FIGS. 1-3 again, the outer tubes 211 of the retractable handle 21 are respectively received in the second handle grooves 121 at the back panel 12 of the luggage body 1 and secured in the second handle grooves 121 by the aforesaid second retaining devices (not shown); the adjustable luggage wheels 13 of the luggage body 1 are suspended below the bottom panel 11; the hidden luggage wheels 15 are respectively received in the respective wheel chambers 122 inside the back panel 12. At this time, the user can use the adjustable luggage wheels 13 and the bottom luggage wheel 14 to support the luggage body 1 on the floor, and operate the grip 213 of the retractable handle 21 to carry the luggage body 1 on the floor.

Referring to FIGS. 3-7, when switching the travel luggage from the first operation mode to the second operation mode, turn the retractable handle 21 about the pivots 22 relative to the luggage body 1 to move the outer tubes 211 of the retractable handle 21 out of the respective second handle grooves 121 and then to set the outer tubes 211 of the retractable handle 21 into the respective first handle grooves 111 in the bottom panel 11, enabling the outer tubes 211 of the retractable handle 21 to be secured to the respective first handle grooves 111 by the aforesaid first retaining devices (not shown). At this time, the pivot blocks 131 of the adjustable luggage wheels 13 are turned in the angled grooves 16 in the respective recessed holes 161 and shifted from the position suspending outside the bottom panel 11 of the luggage body 1 to the position suspending outside the back panel 12; the hidden luggage wheels 15 are respectively extended out of the respective wheel chambers 122 outside the back panel 12 of the luggage body 1. At this time, the user can use the adjustable luggage wheels 13 and the hidden luggage wheels 15 to support the luggage body 1 on the floor and carry other articles on the luggage body 1, and then operate the grip 213 of the retractable handle 21 to push the luggage body 1 on the floor.

In conclusion, the invention is characterized in that: using the pivots 22 to pivotally connect the retractable handle 21 to the luggage body 1, enabling the retractable handle 21 to be selectively shifted between the first operation mode position where the outer tubes 211 of the retractable handle 21 are respectively received in the second handle grooves 121 at the back panel 12 of the luggage body 1 and the adjustable luggage wheels 13 and the bottom luggage wheel 14 support the luggage body 1 on the floor in vertical and a second operation mode position where the outer tubes 211 of the retractable handle 21 are respectively received in the first handle grooves 111 at the bottom panel 11 of the luggage body 1 and the adjustable luggage wheels 13 and the hidden luggage wheels 15 support the luggage body 1 on the floor in horizontal for allowing carrying other articles on the horizontally extended luggage body 1.

What the invention claimed is:

1. A travel luggage, comprising:

a luggage body comprising a bottom panel and a back panel connected at right angles, two adjustable luggage wheels bilaterally and pivotally mounted in the junction between said bottom panel and said back panel and selectively set between a vertical position suspending outside said bottom panel and a horizontal position suspending outside said back panel, two bottom luggage wheels bilaterally mounted at said bottom panel remote from said adjustable luggage wheels, two hidden luggage wheels bilaterally pivotally mounted in said back panel remote from said adjustable luggage wheels and selectively set between an extended position where said hidden luggage wheels are disposed outside said back panel and a received position where said hidden luggage wheels are received inside said back panel, at least one first handle groove located on said bottom panel, and at least one second handle groove located on said back panel and longitudinally connected to said at least one first handle groove; and a direction-changeable retractable handle assembly comprising a retractable handle and at least one pivot mounted in said luggage body to pivotally connect said retractable handle to said luggage body for enabling said retractable handle to be selectively set in a first operation mode position where said retractable handle is positioned in said at least one first handle groove and a second operation mode position where said retractable handle is positioned in said at least one second handle groove.

2. The travel luggage as claimed in claim 1, wherein said luggage body further comprises two wheel chambers bilaterally located in said back panel remote from said adjustable luggage wheels; said hidden luggage wheel are respectively pivotally mounted in said wheel chambers and biasable relative to said luggage body between said extended position and said received position.

3. The travel luggage as claimed in claim 1, wherein said luggage body further comprises two angled grooves bilaterally located in the junction between said bottom panel and said back panel and two recessed holes located in each said angled groove at two opposite sides; each said adjustable luggage wheel of said luggage body comprises a pivot block, said pivot block having two opposite ends thereof respectively pivotally mounted in the said recessed holes in one respective said angled groove, a wheel bracket affixed to said pivot block, and a wheel rotatably mounted in said wheel bracket.

* * * * *